US006602461B2

(12) United States Patent
Krause et al.

(10) Patent No.: US 6,602,461 B2
(45) Date of Patent: Aug. 5, 2003

(54) ARRANGEMENT FOR POURING A POURABLE MELT MADE UP OF A COPPER ALLOY

(75) Inventors: Andreas Krause, Osnabrück (DE); Dirk Rode, Osnabrück (DE); Meinhard Hecht, Hasbergen (DE); Thomas Helmenkamp, Osnabrück (DE); Uwe Quadfasel, Osnabrück (DE); Ralph Frankenberg, Osnabrück (DE); Hubertus Brüning, Mettingen (DE)

(73) Assignee: KM Europa Metal AG, Osnabruck (DE)

( * ) Notice: Subject to any disclaimer, the term of this patent is extended or adjusted under 35 U.S.C. 154(b) by 0 days.

(21) Appl. No.: 10/098,199

(22) Filed: Mar. 14, 2002

(65) Prior Publication Data

US 2002/0130449 A1 Sep. 19, 2002

(30) Foreign Application Priority Data

Mar. 14, 2001 (DE) ..... 101 12 621

(51) Int. Cl.[7] ..... B22D 41/04

(52) U.S. Cl. ..... 266/158; 266/271; 266/236; 222/604

(58) Field of Search ..... 266/158, 271, 266/236; 222/591, 604

(56) References Cited

U.S. PATENT DOCUMENTS 5,320,799 A * 6/1994 Goto et al. ..... 266/213

FOREIGN PATENT DOCUMENTS

| | | |
|---|---|---|
| DE | 41 36 085 | 5/1993 |
| EP | 0 259 772 | 3/1988 |
| EP | 0 352 356 | 1/1990 |
| GB | 1181518 | 2/1970 |

* cited by examiner

*Primary Examiner*—Melvyn Andrews
(74) *Attorney, Agent, or Firm*—Kenyon & Kenyon

(57) ABSTRACT

An arrangement for pouring a pourable melt made up of a copper alloy, which comprises a melting furnace, pivotable about a horizontal pivot axis, having a pouring tube which discharges pourable melt and through which the pourable melt can be conveyed under a shielding gas atmosphere to a filling end of a launder and can be conveyed through an outlet of the launder to a mold. The filling end of the launder is coverable by a hood that seals off the pourable melt from the atmosphere, the pouring tube engaging, with interposition of a seal arrangement, in pivotably movable fashion into the hood. As a result, the pourable melt can be transferred into the launder under a shielding gas atmosphere upon pivoting of the melting furnace and the pouring tub.

17 Claims, 11 Drawing Sheets

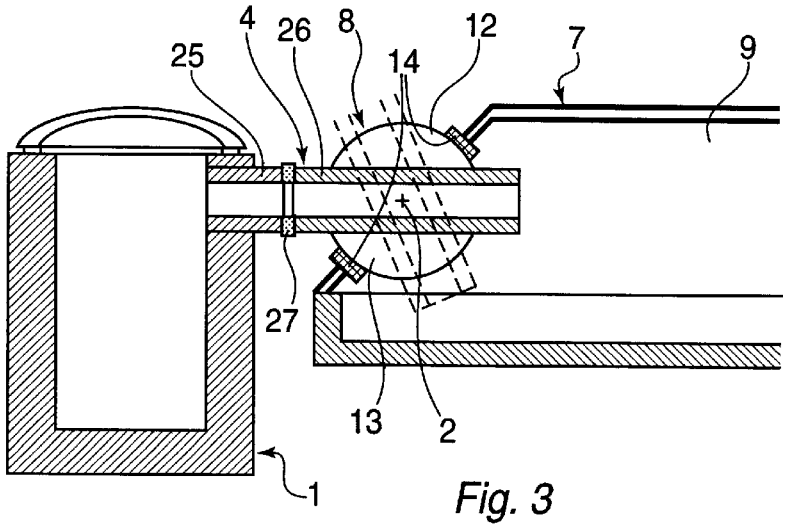
Fig. 3
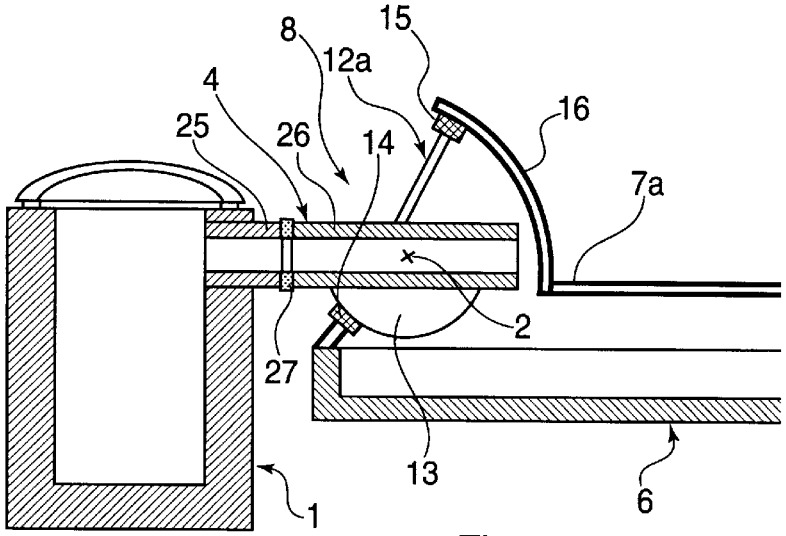
Fig. 4
Fig. 5
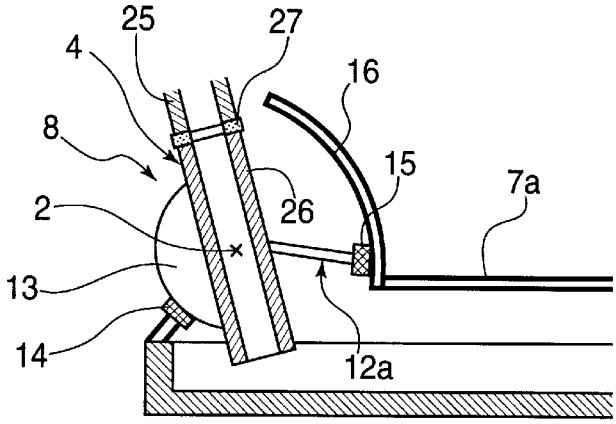

ARRANGEMENT FOR POURING A POURABLE MELT MADE UP OF A COPPER ALLOY

BACKGROUND OF THE INVENTION

When copper is melted under ambient conditions, the pourable melt tends to take up from the ambient air gases that can disadvantageously influence the material's properties. Although the pourable melt can be covered by, for example, charcoal or carbon black, experience indicates that contact with ambient air is not completely prevented. A number of possibilities have therefore been presented in the existing art in order nevertheless to prevent gas uptake from the ambient air.

German Patent 41 36 085 C2 proposes that in the production of oxygen-free copper wire, the melting and pouring operation be made to take place in a shielding gas atmosphere. For that purpose, provision is made to enclose a melting furnace, a downstream holding furnace, a launder, and a pouring trough in a housing, and to operate these devices in a shielding gas atmosphere. For this purpose, all the devices are to be as completely sealed as possible, and can be inductively heated as opposed to the otherwise usual gas heating.

European Patent 0 352 356 B1 describes a method for continuous casting of steel in an atmosphere of an inert nontoxic gas such as argon; the pouring operations during which the liquid steel is in contact with this atmosphere are performed in a sealed, oxygen-free chamber. The technical outlay for setting up such a chamber is considerable, and moreover associated with the disadvantage that only with special breathing apparatus is it possible for operating personnel to enter the chamber to control the pouring process.

European Patent 0 259 772 B1 discloses an arrangement for pouring a copper alloy having an outflow tube leading to a pouring trough, the pouring trough and outflow tube each being enclosed by a hermetically sealable housing in which a non-oxidizing atmosphere made up of a shielding gas is present.

It is not unproblematic to transfer a pourable melt from a melting furnace into downstream arrangements without major losses of the shielding gas atmosphere due to leakage. In this connection, GB 1,181,518 proposes the use of a hearth-type melting furnace, mounted on rollers and having a horizontal longitudinal axis, in which upon pivoting, the melt emerges from the hearth-type melting furnace at the end in the direction of the longitudinal axis. A pouring tube, movably mounted in a gas-tight joint for transferring the pourable melt, allows relative motion of the hearth-type melting furnace with respect to the downstream arrangements without admitting oxygen.

OBJECTS OF THE INVENTION

Proceeding from the existing art, it is the object of the invention to create an arrangement for pouring a pourable melt made up of a copper alloy which makes possible the pouring of copper alloys with little gas uptake and oxide contamination, and which can be coupled with relatively little complexity to a wide variety of melting furnaces that are tiltable about a horizontal pivot axis.

According to the present invention, the achievement of this object encompasses a melting furnace that is pivotable about a horizontal pivot axis, having a pouring tube which discharges a pourable melt and through which the pourable melt can be conveyed under a shielding gas atmosphere to a filling end of a launder. The pourable melt passes out of the launder through an outlet into a downstream mold. What is essential to the invention is that at least the filling end of the launder can be covered by a hood that seals off the pourable melt from the atmosphere, the hood being arranged in principle detachably from the launder. A seal arrangement that is arranged between the pouring tube (which engages in pivotably movable fashion into the hood) and the hood is important in this context. This seal arrangement ensures that upon pivoting of the melting furnace, the pourable melt can be transferred into the launder in a shielding gas atmosphere.

Considerable demands are made on the seal arrangement, since it must be very robust and reliable for pouring operations. The invention advantageously takes into consideration the fact that gas uptake, in particular oxygen, occurs predominantly during filling of the launder, but that oxygen can also be taken up from atmospheric moisture and the launder environment as flow occurs through the launder. These sensitive regions of the pouring arrangement are now protected in technically advantageous fashion by the apparatus according to the present invention. In order to maintain a shielding gas atmosphere, it is necessary in principle in this context to equip the melting furnace, which preferably is an induction furnace, with a gas-tight furnace cover. The most difficult region in terms of sealing technology, however, is the pouring tube engaging in pivotably movable fashion into the hood, which in order to minimize the leakage of shielding gas must be sealed with respect to the hood in every angular position that is provided for.

For that purpose, according to the invention a two-part seal arrangement can preferably be provided, encompassing an upper seal unit provided above the outflow tube and a lower seal unit located below the outflow tube.

An advantageous approach to implementing the sealing units is the seal arrangement having at least one seal unit, associated with the pouring tube, whose surface describes a circular arc about the pivot axis upon pivoting of the melting furnace. For that purpose, the pivot axis of the melting furnace must lie in the region of the seal arrangement.

Suitable in particular as seal units pivotable with the pouring tube are those having an at least partially rotationally symmetrical surface shape. These can be cylindrical segments or hollow cylindrical segments. Spherical segments are also suitable; advantageously, these make possible a further degree of freedom of the seal arrangement. The aforesaid cylindrical or hollow cylindrical segments and spherical segments can be guided in oppositely matching receptacles of the hood; the emergence of shielding gas can be reliably prevented by way of a corresponding gap seal between the hood and the seal unit. Alternatively, a seal element similar to a wiper can be positioned on the hood; the surface of the rotationally symmetrical seal unit moves along this upon pivoting, and seals the hood against shielding gas leakage.

A further advantageous approach is having the seal unit configured as a collar having a seal element at the rim. In the simplest case this can be a plate whose radially external end describes a circular arc (when viewed in cross section) upon pivoting, and which, with an incorporated seal element, is guided in the hood in a receptacle of oppositely matching configuration, i.e. a receptacle of circular arc shape.

In one embodiment, at least one seal unit encompasses a flexible packing seal made of a heat-resistant material.

In addition, the packing seal can be held in a special receptacle so that it can better adapt at all times to the pivoting motion of the pouring tube.

In another embodiment at least one seal unit is configured as a flexible mat made of heat-resistant material. The mat can be made of a textile or felt. Also alternatively conceivable are individual heat-resistant plates that are flexibly interconnected by joints. Because of the flexibility of such mats, it is not absolutely necessary to arrange them above and below the pouring tube. If installation conditions allow, they can also be arranged to the sides of the pouring tube.

In one embodiment, at least one seal unit is configured as a bellows or bellows tube; this of course must be made of a heat-resistant material. A "bellows tube" is also to be understood as a corrugated tube, made of metal or another material, that possesses sufficient flexibility for use as a seal unit.

In another embodiment, the pouring tube is subdivided into two portions of which a first portion is associated with the melting furnace and a second portion with the hood. The two portions can be coupled to one another via an intermediate seal. Although the pouring tube can fundamentally be configured in one piece, two-part pouring tubes are advantageous in certain pouring processes. In particular, the hood-mounted portion can be joined in pivotably movable fashion to the hood via the seal arrangement, while the melting-furnace-mounted portion is immovably joined to the melting furnace. The melting furnace can, with the melting-furnace-mounted portion, be temporarily uncoupled from the launder or hood, allowing greater flexibility in the apparatus according to the present invention.

It is also conceivable, however, for the seal arrangement to be configured so that one seal unit is joined immovably to the pouring tube and the other seal unit is joined immovably to the hood, and the melting furnace, with the pouring tube including the associated seal unit, can be pulled out of the hood. The outflow tube can then closed off in gas-tight fashion at the end during the melting operation, in order to keep the melting furnace under a shielding gas atmosphere even when the launder or hood is uncoupled.

It is also possible, of course, to uncouple the pouring tube into the two portions during the melting operation and to seal off the melting-furnace-mounted portion, in order to operate the melting furnace under a shielding gas atmosphere during initial melting or for specific melt treatments.

Another possibility for maintaining a shielding gas atmosphere in the melting furnace is proposed wherein the hood is detached from the launder during the melting operation, and its opening facing toward the launder is closed off in gas-tight fashion. This has the practical advantage that the hood and launder do not form a rigid unit but rather can be coupled to one another and handled so flexibly that it is possible to replace, clean, or separately preheat a launder without thereby influencing operation of the melting furnace.

A possibility for retrofitting an existing melting furnace with the apparatus according to the present invention is indicated in an embodiment wherein the melting furnace is enclosed in its upper region by a cylindrical furnace hood. Whereas in the case of a furnace cover only the charging opening of the melting furnace is closed off, a furnace hood can enclose the entire upper region of the melting furnace.

The advantages are particularly evident if the melting furnace possesses a channel-like spout that cannot readily be protected from air entry by a furnace cover. In this context, a subsequently installed furnace hood can enclose both the charging opening of the melting furnace and a channel-like spout that opens into a pouring tube, and allow the furnace to operate under shielding gas.

In one embodiment, a mold cover is provided which is intended to protect the pourable melt from atmospheric influences between the outflow of the launder and the inlet into the mold, and here again makes possible pouring under shielding gas.

Usually the outflow of the launder can be closed off with a plug, which must be operated from outside in the context of a hood that covers the launder. According to claim 16, provision is made for the plug, or a means for operating the plug, to pass in sealed fashion through the hood in order to prevent the emergence of shielding gas.

In addition to the hoods described above which completely cover a launder, applications are also conceivable in which shorter hoods, which cover only the inflow end of the launder and leave exposed the outflow with the plug, are advisable, for example in order to make possible better operability of the plug. If a short hood of this kind is present on the launder, care must be taken that an unnecessarily large quantity of shielding gas does not escape through the launder-side opening of the hood. A solution to this problem is provided in one embodiment wherein the side of the hood facing away from the melting furnace rests on a crosspiece of the launder. The crosspiece is dimensioned in such a way that it extends from the upper rim of the launder to below the level of the pourable melt present in the launder, thereby preventing the emergence of shielding gas in the flow direction of the pourable melt. When alloy constituents with a particular high oxygen affinity are used in the copper melt, or in order to reduce heat losses, it may be advisable to cover the pourable melt with a so-called melt covering agent, as is done in the conventional melting procedure in air. Carbon-based melt covering agents, for example charcoal or carbon black, or covering salts or covering agents made of oxides and/or carbonates, are usually used for this purpose. Melt covering agents of this kind can also, if necessary, be used in supplementary fashion beneath the hood and also in the melting furnace simultaneously with a shielding gas atmosphere.

The apparatus according to the present invention is suitable in particular for melting furnaces in which the filling end of the launder is arranged perpendicular to the pivot axis. This has to do in particular with the flow direction of the pourable melt, defined by the direction of the pouring tube. As it proceeds further, the launder can of course run at an angle in order to convey the pourable melt to one or several molds. A plurality of outflows of the launder, with associated plugs, can accordingly also be provided.

Gases with an inerting effect having constituents made of nitrogen and/or argon and/or helium, as well as gases having gas additives with a reducing effect, such as carbon monoxide and/or hydrogen, are suitable as the shielding gas for operation of the apparatus according to the present invention.

With the apparatus according to the present invention it is possible to implement a wide variety of variant methods for melting metals and/or alloys, in particular copper and copper alloys, and for pouring them under a shielding gas atmosphere while largely excluding ambient air. A few variant methods will be explained below by way of example.

The apparatus makes possible, for example, a method for pouring a metal alloy, in particular a copper alloy, in which the pourable melt from a melting furnace is poured with the continuous casting method at least partially in a shielding gas atmosphere, the melting furnace first being loaded with a melting charge which is then melted. It is also conceivable to transfer pourable melt into the melting furnace from a separate furnace. During melting, further alloy constituents can be added; this can be performed, for example, in air, the pourable melt with its oxygen affinity advantageously being covered by a melt covering substance.

After addition of all the alloy constituents, the furnace chamber is closed and, depending on the configuration of the downstream apparatus, a shielding gas atmosphere is created either only in the furnace chamber and the attached pouring tube, or in the pouring tube portion if the latter is closed off at the end as defined in claim 11. As soon as the pouring tube communicates with the hood, the shielding gas atmosphere is also created in the hood. For that purpose, the hood can be connected to the furnace and positioned on the launder even before the melting charge and alloy constituents are first melted. Another possibility is for the hood to be positioned on the launder and connected to the furnace while the melting charge and alloy constituents are being melted. A third possibility provides for the hood to be connected to the furnace during initial melting of the melting charge and the alloy constituents, and to be closed off by a launder-end hood closure before being flooded with shielding gas. After sealing, melting continues under a shielding gas atmosphere, and pouring is performed under a shielding gas atmosphere after removal of the hood closure and positioning of the hood on the launder.

In every case, pouring of the pourable melt into the launder takes place under a shielding gas atmosphere; in addition, the mold, protected by a mold cover, can also be filled under a shielding gas atmosphere.

A useful development of the apparatus lies in the fact that additives can be added to the pourable melt in the launder through a transfer lock in the hood. If a hood that covers only the filling end of the launder is used, the region of the pourable melt in the launder not covered by the hood can be equipped with a melt covering material.

In the same way that the hood can be equipped with a transfer lock, charging of the furnace through a transfer lock in the furnace cover or furnace hood is of course also possible, so that the melting operation can take place entirely under a shielding gas atmosphere.

Two concrete examples of process-related use of the apparatus according to the present invention for production of the copper alloy CuMg0.7P are given below:

First the open melting furnace is loaded with melting charge, for example copper cathode sheets, and the melting charge is then melted in air under a charcoal cover. Further material, for example cathode sheets, CuP master alloys, and CuMg master alloys, is then added in air, and melting continues in air. The melting furnace is then closed and, with the hood positioned on the launder, is flooded with argon as shielding gas. The molten metal is then poured into the launder under a shielding gas atmosphere, the hood and launder being completely covered and the mold being preceded by a mold cover.

According to a second variant, the open melting furnace is loaded with melting charge, whereupon the furnace cover and the melting-furnace-mounted portion of the pouring tube are closed off with a closure plate and the melting furnace, along with the associated portion of the pouring tube, is flooded with argon. The launder and the hood are not yet positioned at this time. The initial melting operation then follows under the shielding gas atmosphere with charcoal covering, further material being added through a transfer lock or alternatively through the open furnace cover, the furnace chamber then being closed again and flooded with shielding gas. During further melting under shielding gas, the launder along with the hood is positioned in front of the melting furnace and the argon shielding gas atmosphere is created in the hood, the two portions of the pouring tube being connected. Pouring of the molten metal into the launder under the shielding gas atmosphere, and filling of the mold with its associated mold cover, then follow.

The special features of the aforesaid methods are aimed at eliminating the disadvantageous influence of ambient air constituents on the molten metal. The invention is therefore applicable with particular advantage to molten metals that are intended to contain low concentrations of dissolved oxygen, oxides, and/or nitrides.

Elements that tend to form oxides are, for example, beryllium (Be), magnesium (Mg), zirconium (Zr), aluminum (Al), titanium (Ti), silicon (Si), boron (B), manganese (Mn), chromium (Cr), zinc (Zn), phosphorus (P), iron (Fe), tin (Sn), cobalt (Co), nickel (Ni), and lead (Pb). Elements that tend to form nitrides are zirconium (Zr), titanium (Ti), aluminum (Al), tantalum (Ta), boron (B), niobium (Nb), magnesium (Mg), vanadium (V), silicon (Si), and chromium (Cr). The apparatus according to the present invention is thus particularly suitable for producing pourable melts with the aforesaid alloying elements. Surprisingly, however, it has been found in practice that the particular advantages of the invention occur only in the context of specific pourable melts and alloys, while other pourable melts or alloys exhibit relatively unproblematic behavior, for example alloys of the group Cu, Pb, Zn, even though they contain up to 10% and more of the oxide-forming alloying elements Pb and Zn. Also unproblematic is CuSP with approx. 0.2 to 0.5% sulfur (S) and 0.003 to 0.012% phosphorus (P), although sulfur and in particular phosphorus (used for deoxidation) can be intensively oxidized by atmospheric oxygen. Additional unproblematic pourable melts are, for example, CuNi melts if no further elements (other than nickel) that have a strong tendency to form oxides or nitrides are present.

BRIEF DESCRIPTION OF THE FIGURES

The present invention is explained below in more detail with reference to exemplary embodiments depicted schematically in the drawings.

FIG. 3 illustrates in vertical longitudinal section a first embodiment of seal arrangements having seal units that, upon pivoting of a melting furnace, describe a circular arc about a pivot axis;

FIG. 4 illustrates in vertical longitudinal section a second embodiment of seal arrangements having seal units that, upon pivoting of a melting furnace, describe a circular arc about a pivot axis;

FIG. 5 illustrates in vertical longitudinal section a third embodiment of seal arrangements having seal units that, upon pivoting of a melting furnace, describe a circular arc about a pivot axis;

DETAILED DESCRIPTION OF THE FIGURES

Figure 1:
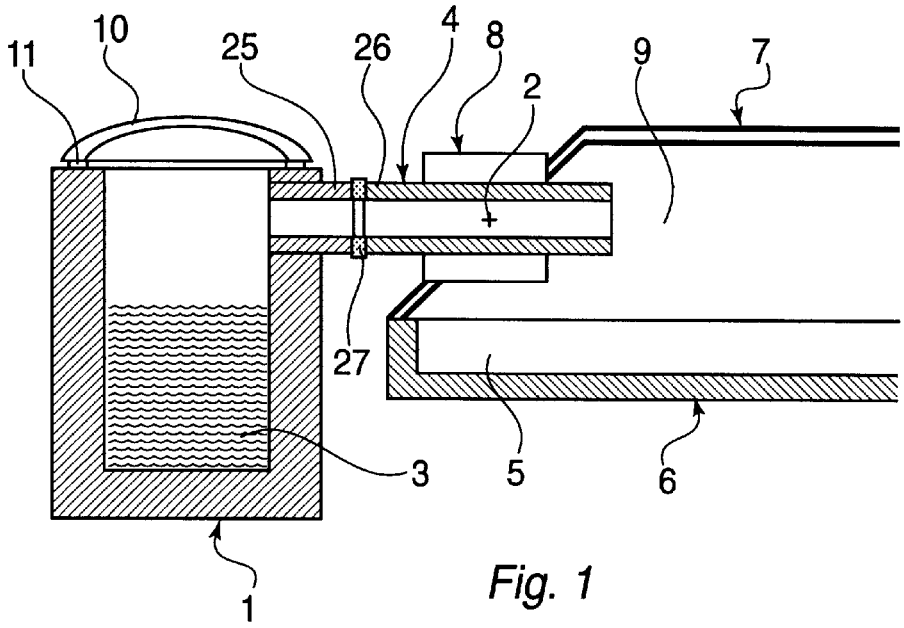
FIG. 1 illustrates in vertical longitudinal section an apparatus for pouring a pourable melt during a melting operation.
Figure 2:
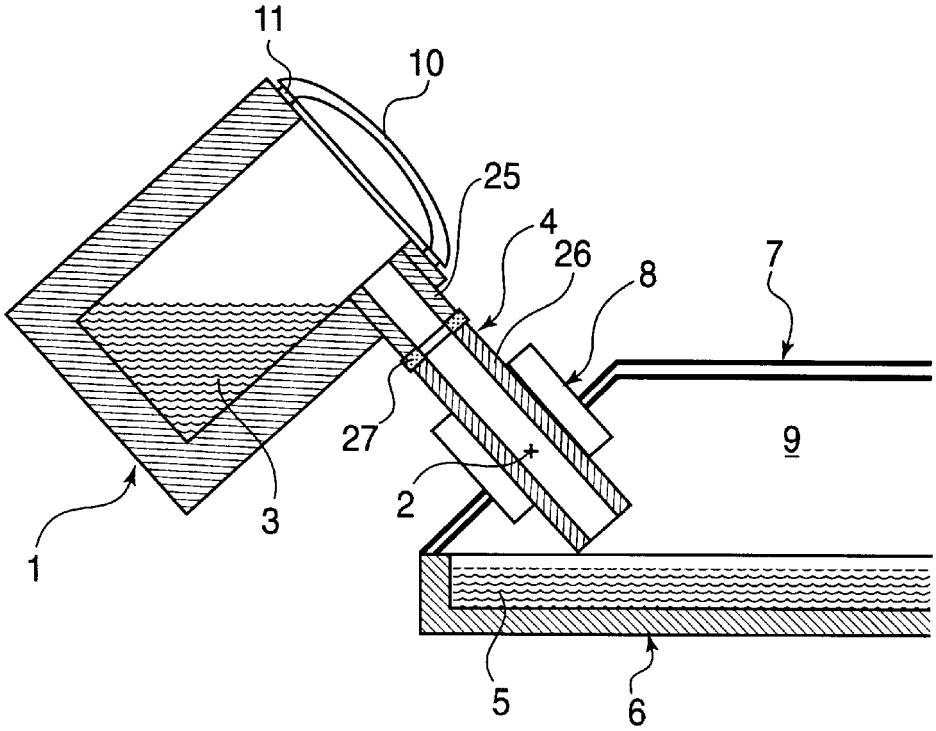
FIG. 2 illustrates in vertical longitudinal section an apparatus for pouring a pourable melt during a pouring operation.

FIGS. 1 and 2 illustrate how a melting furnace 1 is displaceable about a horizontal pivot axis 2, and how pourable melt 3 present therein is conveyed through a pouring tube 4 to a filling end 5 of a launder 6. Arranged above launder 6 is a hood 7 which protects pourable melt 3 transferred into launder 6 from the environment and into which pouring tube 4 engages in pivotably movable fashion. Introduced between pouring tube 4 and hood 7 is a seal arrangement 8 that on the one hand prevents air from accessing pourable melt 3, and on the other hand prevents the emergence of shielding gas from the interior of melting furnace 1, pouring tube 4, and hood 7, so as thereby to maintain a shielding gas atmosphere 9 in the aforementioned regions.

Also serving this purpose is a furnace cover 10 that closes off melting furnace 1 in gas-tight fashion via an interposed furnace seal 11. Pouring tube 4 is divided into portions 25, that are joined to one another with interposition of a seal 27.

Seal arrangement 8 depicted schematically in FIGS. 1 and 2 is explained below in more detail with reference to FIGS. 3 through 14. Fundamentally each seal arrangement 8 is divided into an upper seal unit 12, 12*a*–12*e* arranged above pouring tube 4, and a lower seal unit 13, 13*a*–13*e* arranged below pouring tube 4.

In the exemplary embodiment shown in FIGS. 3, upper seal unit 12 and lower seal unit 13 are configured as hollow cylindrical segments whose surfaces describe a circular arc about pivot axis 2 upon pivoting of melting furnace 1. Pouring tube 4 is shown in the pivoted position with dashed lines. During pivoting, seal elements 14 attached to hood 7 rest against the surfaces of seal units 12, 13 and prevent any gas exchange with the environment.

FIGS. 4 and 5 show an embodiment in which upper seal 12*a* is configured as a radial strut having at the end a seal element 15 which, upon pivoting of melting furnace 1, slides along the concave inner side of a receptacle 16, having the shape of a circular arc in section, of a hood 7*a*. Lower seal unit 13 is once again configured as a hollow cylindrical segment that slides with its surface along a seal element 14.

Figure 6:
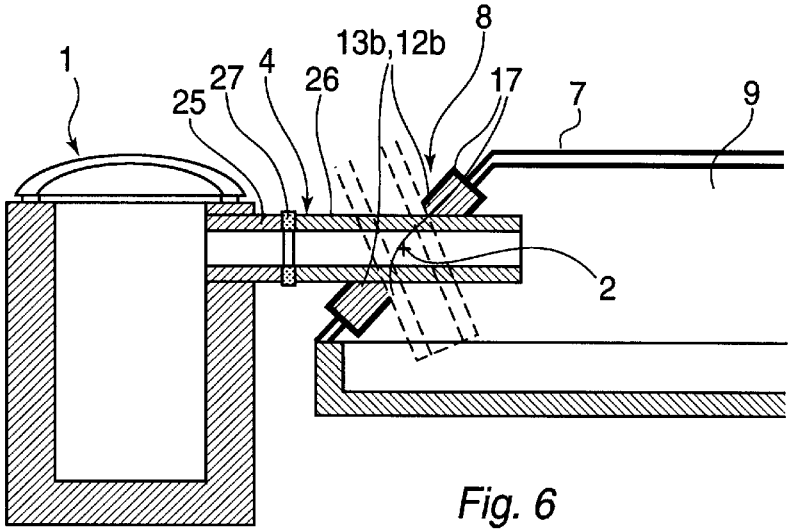
FIG. 6 illustrates in vertical longitudinal section an additional embodiment of the seal unit.

In addition to seal units 12, 12*a*, 13 that seal in an arc shape, FIG. 6 shows that packing seals made of a heat-resistant material are also suitable as seal units 12*b*, 13*b*. These seal units 12*b*, 13*b* can be retained in receptacles 17 of hood 7 so they can faithfully follow the pivoting motion of pouring tube 4 about pivot axis 2. Receptacle 17 can optionally be joined with limited pivoting movability to hood 7.

Figure 7:
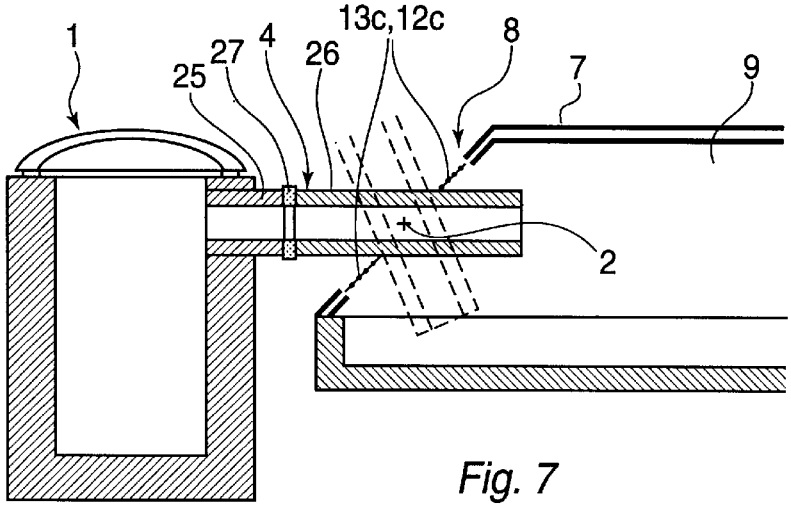
FIG. 7 illustrates in vertical longitudinal section an additional embodiment of the seal unit.

Also suitable instead of packing seals are seal units 12*c*, 13*c* in the form of flexible mats made of heat-resistant material (FIG. 7). This can be a textile or also felt. It is furthermore possible to interconnect individual plates in articulated fashion in order to ensure the necessary flexibility of seal arrangement 8.

Figure 8:
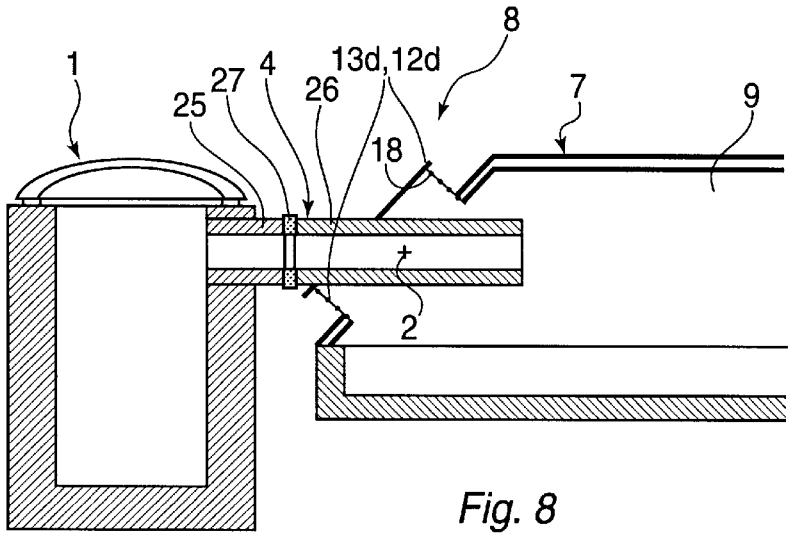
FIG. 8 illustrates in vertical longitudinal section an additional embodiment of the seal unit.
Figure 9:
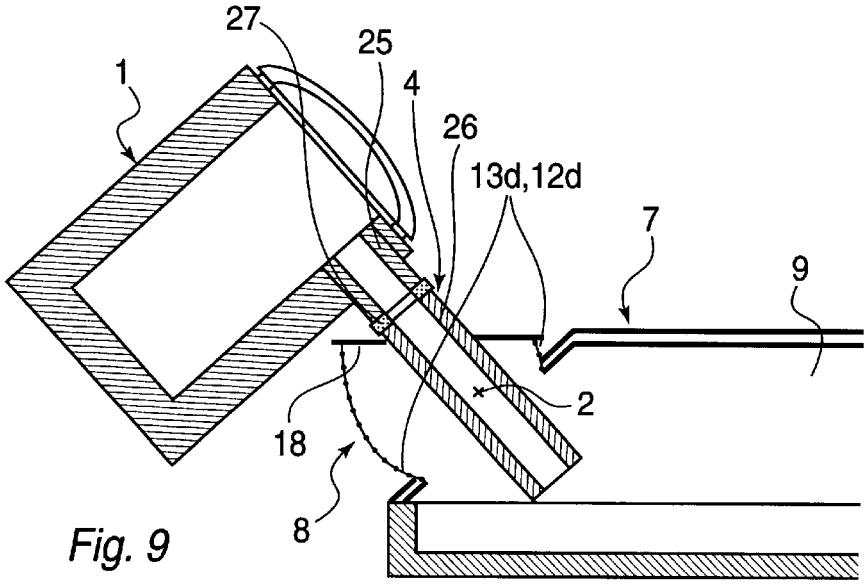
FIG. 9 illustrates in vertical longitudinal section an additional embodiment of the seal unit.

FIGS. 8 and 9 show a seal arrangement in which seal units 12*d*, 13*d* are configured as bellows, said bellows being joined via a plate 18 to pouring tube 4.

Figure 10:
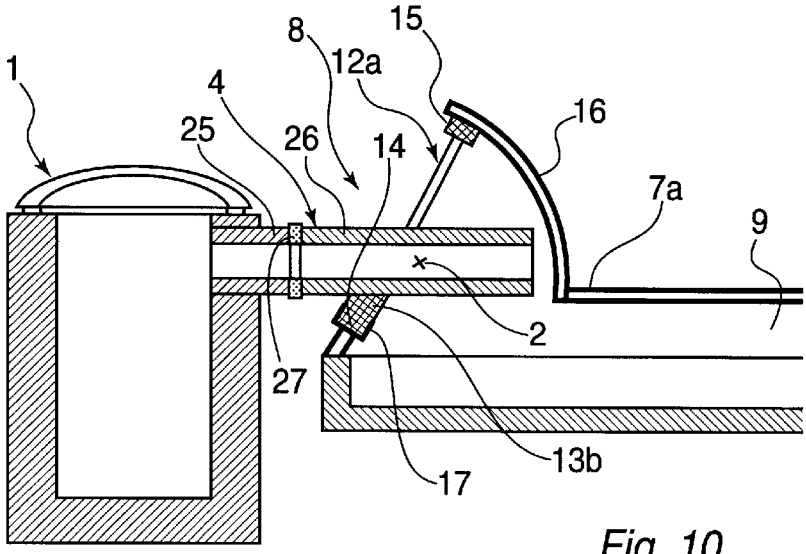
FIG. 10 illustrates in vertical longitudinal section a combination of the seal units depicted in one of FIGS. 3 through 9.
Figure 11:
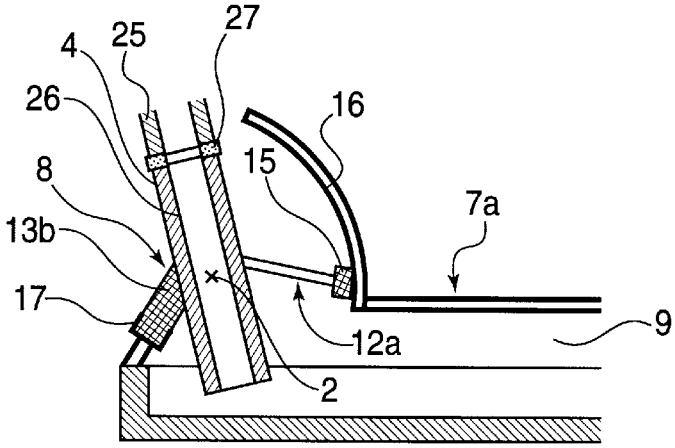
FIG. 11 illustrates in vertical longitudinal section a combination of the seal units depicted in one of FIGS. 3 through 9.

FIGS. 10 and 11 show an approach in which upper seal unit 12*a* is configured as a radial strut having seal element 15, and lower seal unit 13*b* is configured as a flexible packing seal in a receptacle 17 of hood 7*a*. In this embodiment as well, receptacle 17 can be joined to hood 7*a* with at least limited pivoting movability.

Figure 12:
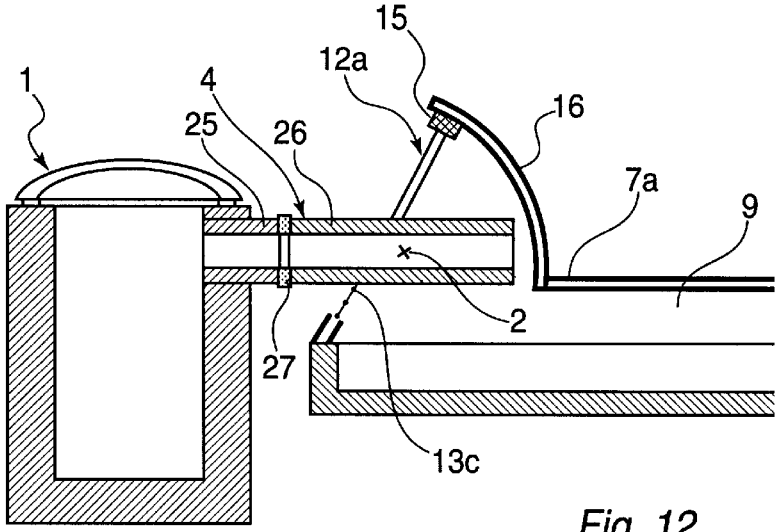
FIG. 12 illustrates in vertical longitudinal section a combination of the seal units depicted in one of FIGS. 3 through 9.

In FIG. 12, upper seal unit 12*a* configured as a radial strut having sealing element is combined with a flexible mat as lower seal unit 13*c*.

Figure 13:
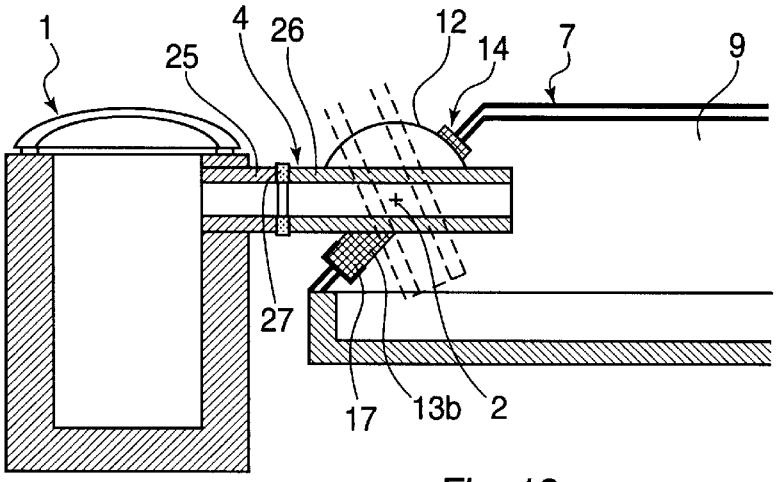
FIG. 13 illustrates in vertical longitudinal section a combination of the seal units depicted in one of FIGS. 3 through 9.
Figure 14:
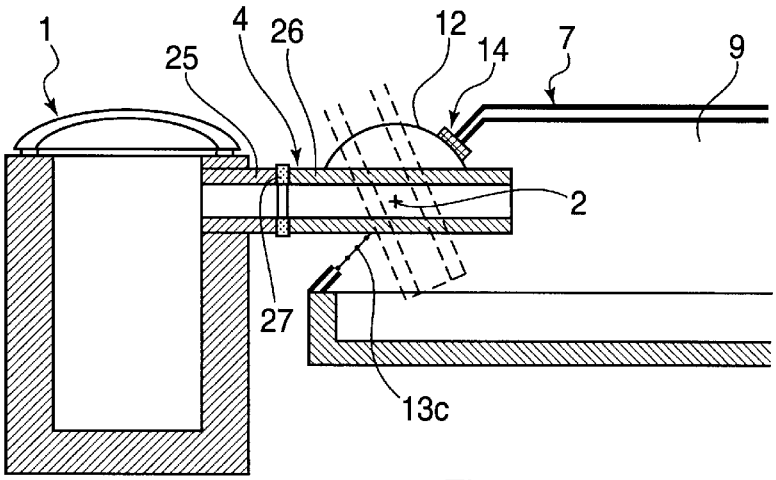
FIG. 14 illustrates in vertical longitudinal section a combination of the seal units depicted in one of FIGS. 3 through 9.

FIG. 13 shows the combination of an upper seal unit 12 configured as a cylindrical segment with a packing seal as lower seal unit 13*b*, and FIG. 14 with a mat made of heat-resistant material as lower seal unit 13*c*. In a configuration as depicted in FIG. 13 in particular, pouring tube 4 is easier to pull out of hood 7 so that the apparatus is very flexible.

Figure 15:
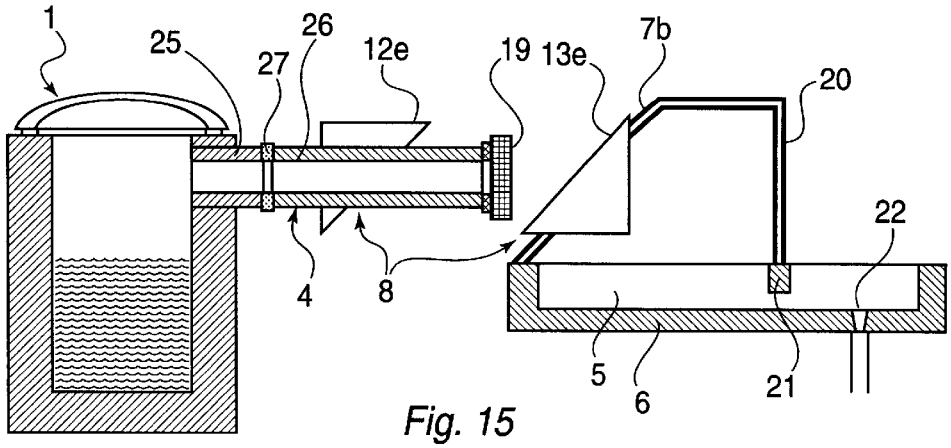
FIG. 15 illustrates in vertical longitudinal section apparatuses having a relatively long hood positioned on a launder, the pouring tube being separated from the hood and closed off at the end.

FIG. 15 shows such a case, hood 7*b* being positioned on launder 6 while melting furnace 1 with pouring tube 4 is arranged separately from hood 7*b*. Hood 7*b* and pouring tube 4 have a respective sealing unit 12*e*, 13*e* associated with them. In this exemplary embodiment, pouring tube 4 is closed off at the end by a cap 19. Also depicted in FIG. 15 is the configuration of a short hood 7*b* that does not extend over the entire length of launder 6 but instead covers only filling end 5 of launder 6. Side 20 of hood 7*b* that faces away from melting furnace 1 rests on a crosspiece 21 (shown here in section) in launder 6.

Figure 16:
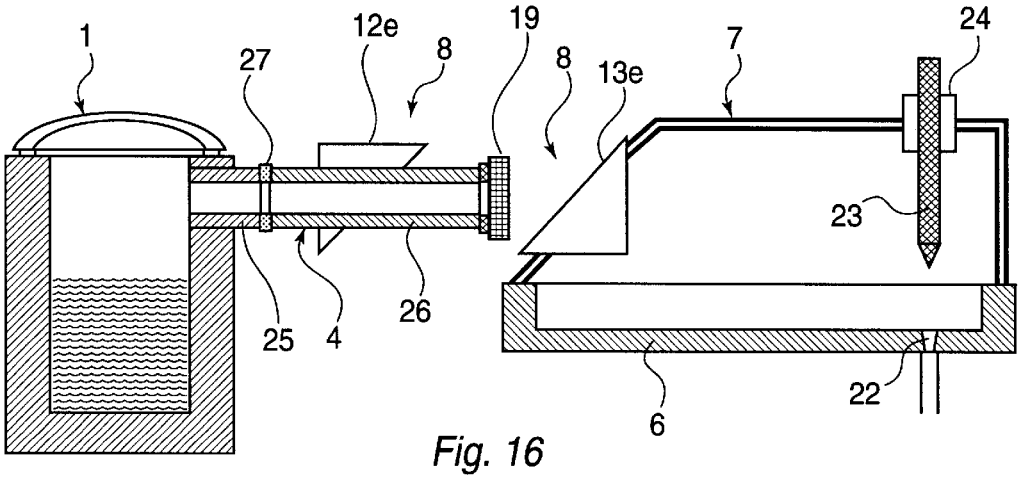
FIG. 16 illustrates in vertical longitudinal section apparatuses having a relatively short hood positioned on a launder, the pouring tube being separated from the hood and closed off at the end.

In contrast to the exemplary embodiment shown in FIG. 16, in which hood 7 extends over the entire length of launder 6, in FIG. 15 an outlet for pourable melt 3 in launder 6 is freely accessible.

The complete encapsulation of launder 6 as shown in FIG. 16 requires that a plug 23, necessary for closing off outlet 22, be sealed with respect to hood 7 by way of a seal element 24 in order to prevent the emergence of shielding gas from hood 7.

Once melting furnace 1 and launder 6 have been brought together, melting furnace 1 can be pivoted about a pivot axis 2 as in the exemplary embodiments described previously.

Figure 17:
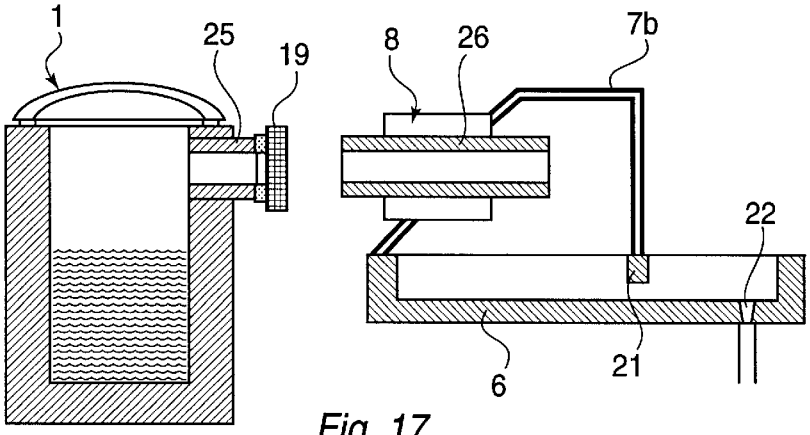
FIG. 17 illustrates in vertical longitudinal section apparatuses having a relatively short hood positioned on a launder, the portion of the pouring tube associated with the melting furnace being closed off at the end.
Figure 18:
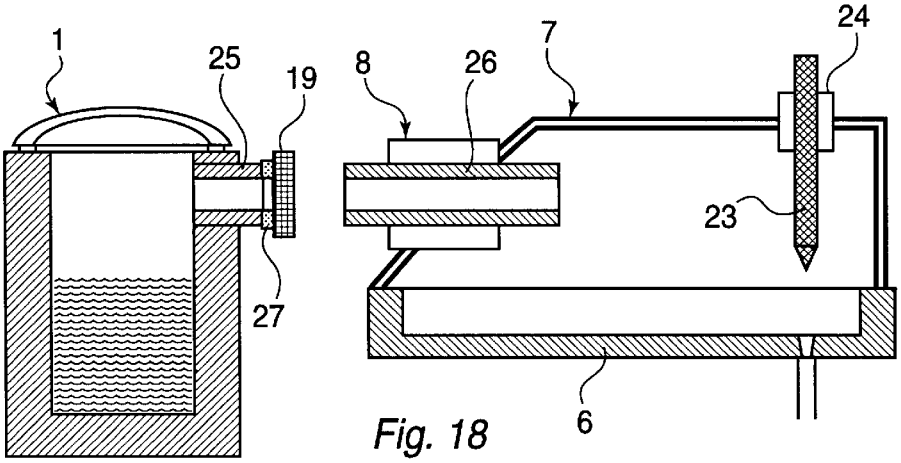
FIG. 18 illustrates in vertical longitudinal section apparatuses having a relatively long hood positioned on a launder, the portion of the pouring tube associated with the melting furnace being closed off at the end.

FIGS. 17 and 18 show exemplary embodiments that on the one hand differ in the use of a short hood 7*b* and a long hood 7, but in which on the other hand pouring tube 4 is divided into a first portion 25 associated with melting furnace 1 and a second portion 26 associated with hood 7*b*, 7. The embodiment shown in FIGS. 17 and 18 has the advantage that during flexible handling of melting furnace 1 and hood 7*b*, 7, the respective seal arrangement 8 (depicted only schematically) can remain on hood 7*b*, 7 together with the hood-mounted portion 26, while the melting-furnace-mounted portion 25 can in turn be closed off in gas-tight fashion with a cap 19.

Figure 19:
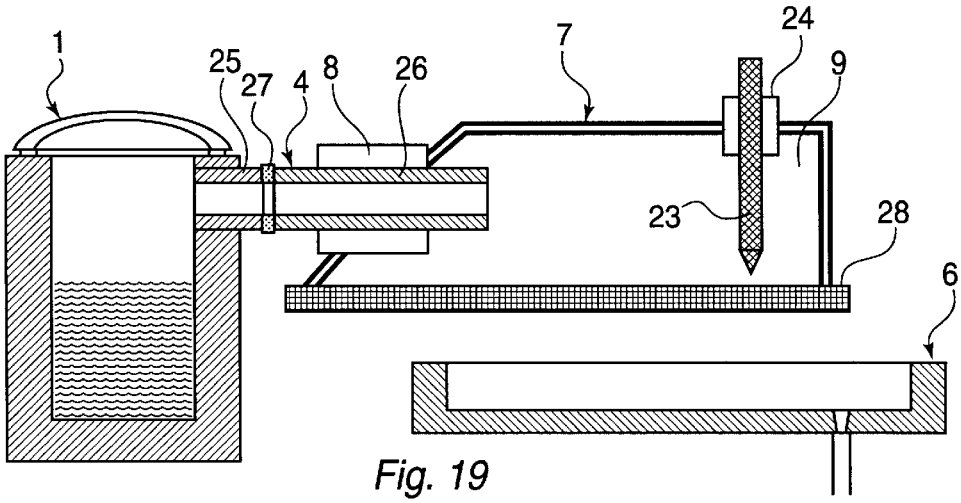
FIG. 19 illustrates in vertical longitudinal section an apparatuses having a relatively long hood, the opening facing toward a launder being in each case closed off.
Figure 20:
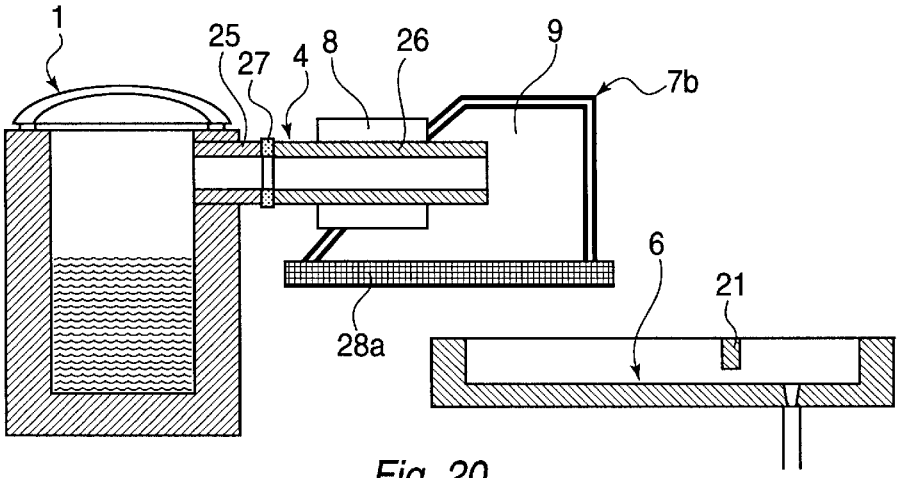
FIG. 20 illustrates in vertical longitudinal section an apparatuses having a relatively short hood, the opening facing toward a launder being in each case closed off.

According to the embodiments of FIGS. 19 and 20, which once again differ in the use of hoods 7, 7*b* of different lengths, hoods 7, 7*b* are not positioned on a launder 6 but instead are joined to melting furnace 1 via pouring tube 4 and seal arrangement 8 (depicted schematically). Hood closures 28, 28*a* arranged on the launder side close off hood 7, 7*b* in gas-tight fashion so that a shielding gas atmosphere 9 is possible in melting furnace 1, pouring tube 4, and hoods 7, 7*b* uncoupled from launder 6.

Figure 21:
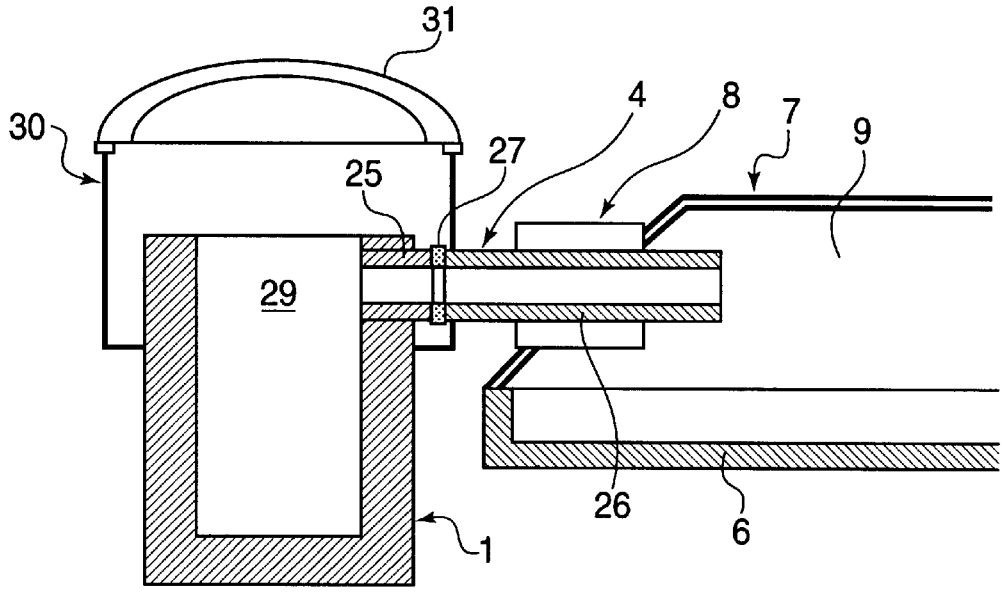
FIG. 21 illustrates in vertical longitudinal section an embodiment of an apparatuses in which the upper region of a melting furnace is surrounded by a furnace hood.
Figure 22:
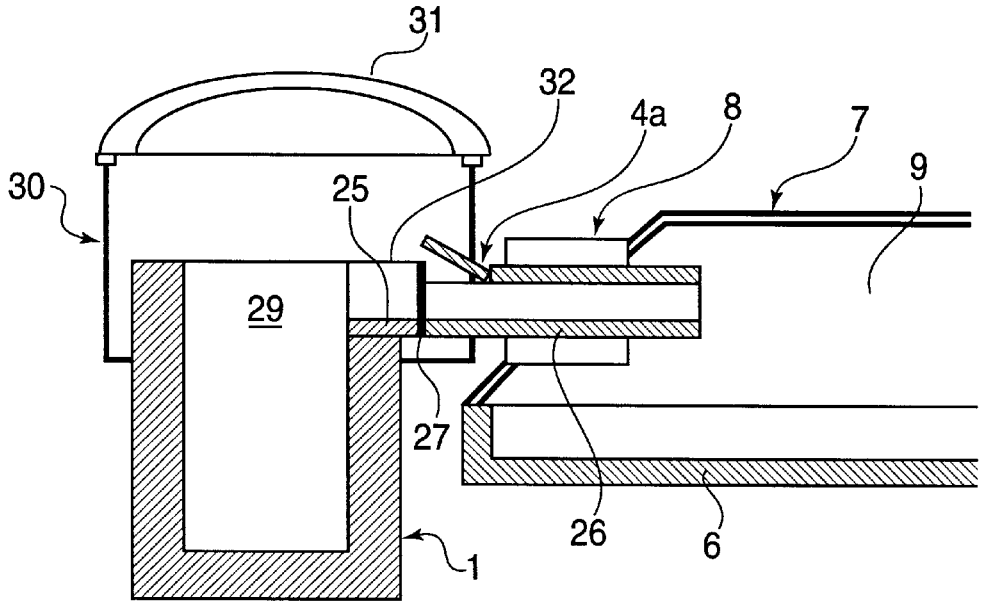
FIG. 22 illustrates in vertical longitudinal section an embodiment of an apparatuses in which the upper region of a melting furnace is surrounded by a furnace hood.

In the context of the embodiment of FIG. 21, melting furnace 1 is surrounded in its upper region 29 by a furnace hood 30 having a furnace cover 31. The advantages of this arrangement become apparent in particular if melting furnace 1 possesses a spout 32 (FIG. 22) that opens into an attached pouring tube 4*a*. In this exemplary embodiment, pouring tube 4*a* is enlarged upward in funnel fashion at its end facing toward spout 32, so as to capture inflowing pourable melt 3 without loss. Seal arrangement 8 is once again illustrated only schematically in the depictions of FIGS. 21 and 22.

Figure 23:
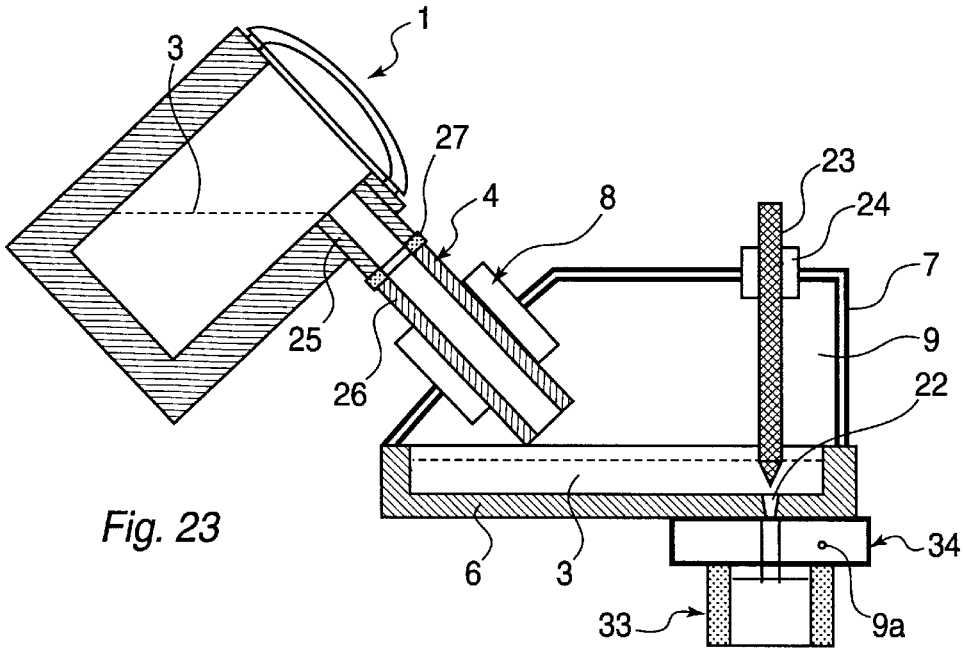
FIG. 23 illustrates in vertical longitudinal section an apparatuses having a relatively long hood and a mold cover arranged between an outflow and a mold.
Figure 24:
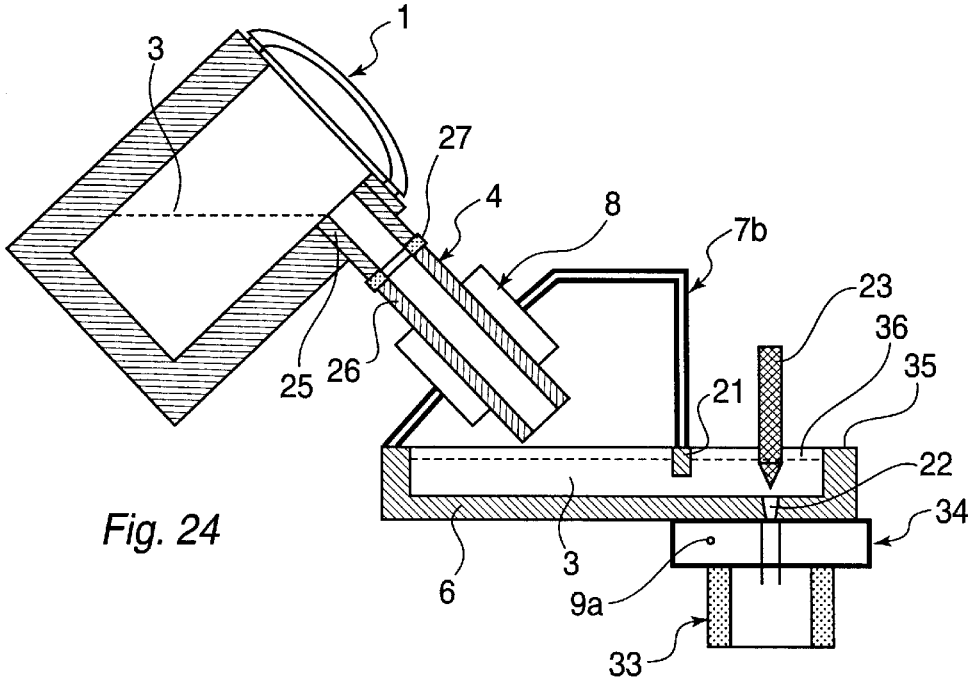
FIG. 24 illustrates in vertical longitudinal section an apparatuses having a relatively short hood and a mold cover arranged between an outflow and a mold.

The embodiments of FIGS. 23 and 24 largely correspond to the embodiments explained previously, with the difference that a mold 33 downstream from outlet 22 of launder 6 is equipped with a mold cover 34, in which a shielding gas atmosphere 9*a* also exists and which prevents contact between ambient air and pourable melt 3 emerging from launder 6. It is additionally evident from FIG. 24 that crosspiece 21 extends from upper rim of launder 6 to below level 36 of pourable melt 3 present in launder 6. This ensures sealing of hood 7*b* with respect to the environment as long as sufficient pourable melt 3 is present in launder 6.

In both embodiments, seal arrangement 8 is once again illustrated only schematically.

Figure 25:
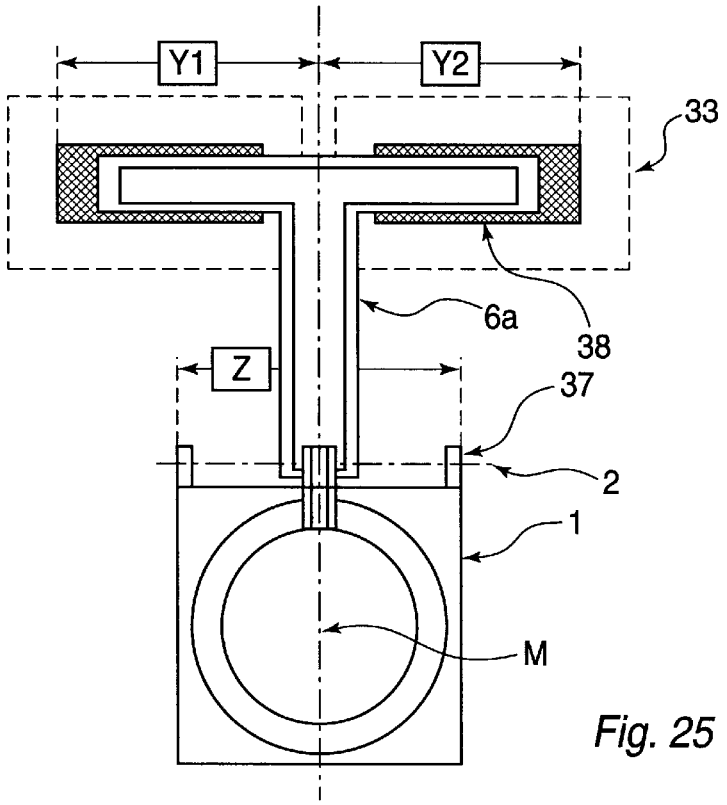
FIG. 25 illustrates in plan view one embodiment of a launder having a particular configurations.
Figure 26:
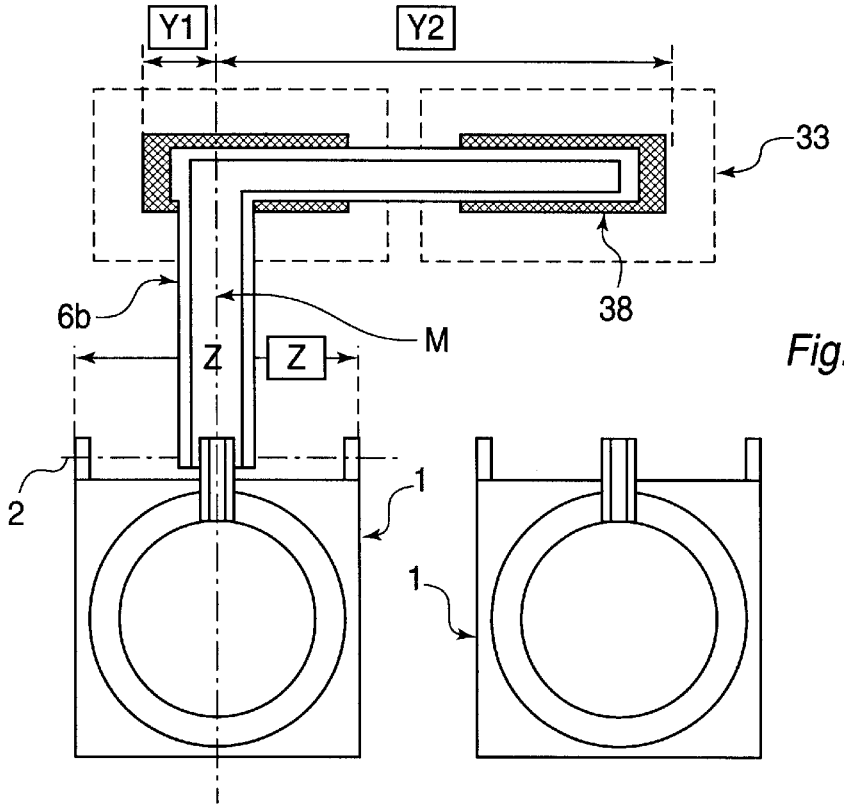
FIG. 26 illustrates in plan view one embodiment of a launder having a particular configurations.
Figure 27:
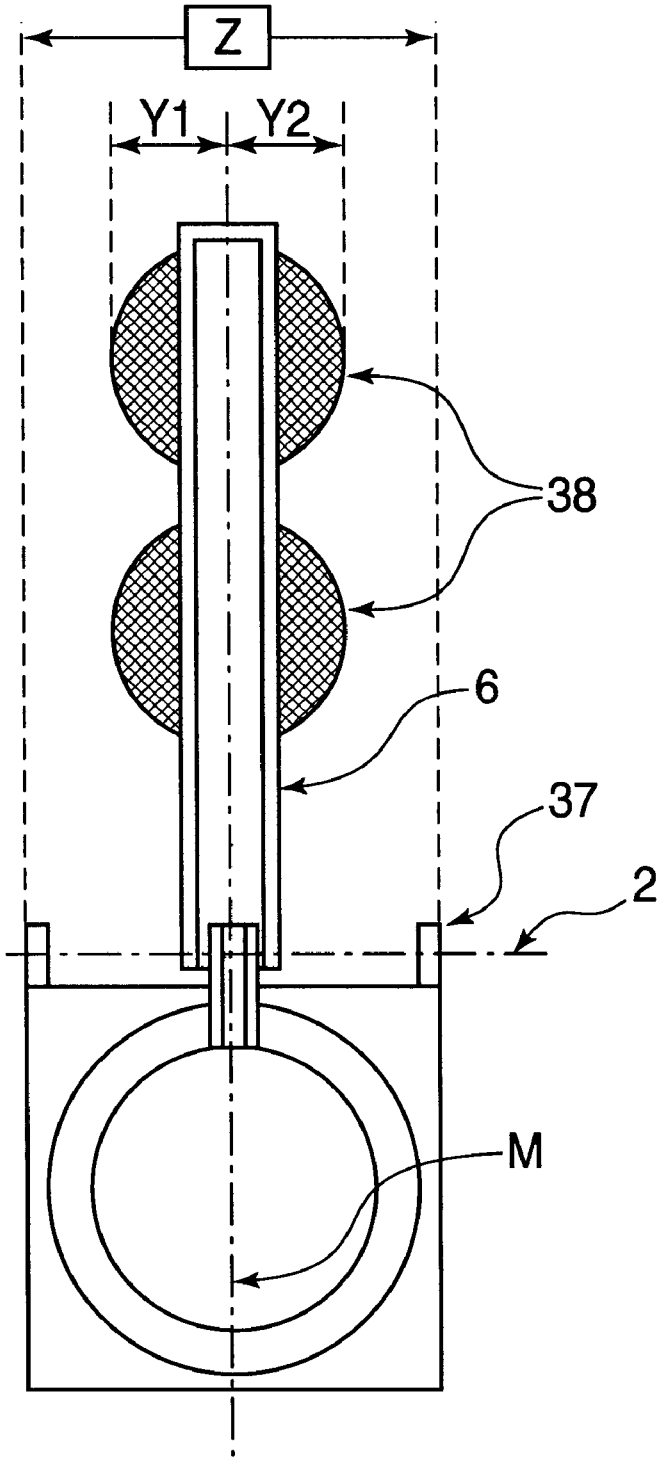
FIG. 27 illustrates in plan view one embodiment of a launder having a particular configurations.

An essential feature of the invention is that the apparatus can advantageously be installed in pouring facilities having characteristic geometric arrangements. One such characteristic arrangement is that in which launder 6 extends largely perpendicular to pivot axis 2 of melting furnace 1, and molds 33 that are to be filled are correspondingly located in the pivoting direction largely in front of melting furnace 1 or slightly laterally offset from melting furnace 1. In this context, there are specific relationships between the size of melting furnace 1 and the size and number of the casting openings to be poured into simultaneously. In the case of melting furnace 1, experience indicates that external spacing Z of the tilting joints of melting furnace 1 represents an approximate indication of furnace size, so that it can be related to the arrangement of the pouring lines. A fundamental criterion of the exemplary embodiments depicted in FIGS. 25 through 27 is that Y should be less than 3*Z, Y being the dimension from centerline M of melting furnace 1 to the outer rim of the respective casting opening 38. With symmetrical launders 6*a* as shown in FIG. 25, Y1 equals Y2, whereas with asymmetrical launders 6*b* as illustrated in FIG. 26, Y1 and Y2 can have different values. In the context of double-line casting as shown in FIG. 27, these values are always maintained provided launder 6 is arranged in front of melting furnace 1.

What is claimed is:

1. An arrangement for pouring a copper alloy pourable melt comprising:

a melting furnace that is pivotable about a horizontal pivot axis, the furnace configured so that the pourable melt is conveyed under a shielding gas atmosphere;

a launder for conveying the pourable melt from the furnace, the launder having a filling end and an outlet;

a hood covering at least the filling end of the launder so that the pourable melt is sealed off from an ambient atmosphere;

a pouring tube connected to the melting furnace;

a seal arrangement interposed between the pouring tube and the hood, the seal arrangement allowing the pouring tube to engage the hood in pivotably movable fashion; and a mold connected to the outlet of the launder.

2. The arrangement as defined in claim 1, wherein the seal arrangement includes an upper seal unit disposed on a first portion of the pouring tube and a lower seal unit disposed on a second portion of the pouring tube.

3. The arrangement as defined in claim 2, wherein the seal arrangement includes at least one seal unit associated with the pouring tube, the at least one seal unit having at least one circular-arc segment.

4. The arrangement as defined in claim 3, wherein the at least one seal unit is one of a cylindrical segment, a hollow cylindrical segment, and a spherical segment that is guided in a sealed manner in one of a receptacle connected to the hood, the receptacle having an oppositely matching configuration, and a seal element connected to the hood.

5. The arrangement as defined in claim 3, wherein the at least one seal unit is a radial strut having an end, a seal element being attached to the end of the radial strut so that the seal element is guided in a receptacle of oppositely matching configuration of the hood.

6. The arrangement as defined in claim 2, wherein the seal arrangement includes at least one seal unit, the at least one seal unit being a flexible packing seal fabricated from a heat-resistant material.

7. The arrangement as defined in claim 6, wherein the flexible packing seal is held in a receptacle constituting a component of one of the hood and the launder.

8. The arrangement as defined in claim 2, wherein the seal arrangement includes at least one seal unit, the at least one seal unit being configured as a flexible mat fabricated from a heat-resistant material.

9. The arrangement as defined in claim 2, wherein the seal arrangement includes at least one seal unit, the at least one seal unit being configured as one of a bellows and a bellows tube.

10. The arrangement as defined in claim 1, wherein the pouring tube is subdivided into a first portion connected to the melting furnace and a second portion connected to the hood, the first portion and the second portion being coupled to one another via an intermediate seal.

11. The arrangement as defined in claim 10, wherein at least the first portion of the pouring tube is sealed in gas-tight fashion at a time of a melting operation.

12. The arrangement as defined in claim 1, wherein the hood is detached from the launder at a time of a melting operation, and an opening facing toward the launder is sealed in gas-tight fashion by a hood closure.

13. The arrangement as defined in claim 1, wherein an upper region of the melting furnace is enclosed by a cylindrical furnace hood.

14. The arrangement as defined in claim 13, wherein the melting furnace further includes a channel-like spout, the channel-like spout opening into the pouring tube, the channel-like spout being enclosed in a sealed fashion by the cylindrical furnace hood.

15. The arrangement as defined in claim 1, wherein a mold cover is arranged between the outlet of the launder and the mold.

16. The arrangement as defined in claim 1, wherein the outlet is closed-off by a plug that passes in sealed fashion through the hood.

17. The arrangement as defined in claim 1, wherein the hood covers only the filling end of the launder, and a side of the hood facing away from the melting furnace rests on a crosspiece extending from an upper rim of the launder to below a level of the pourable melt present in the launder.

* * * * *